US006195804B1

(12) United States Patent
Fraser

(10) Patent No.: US 6,195,804 B1
(45) Date of Patent: Mar. 6, 2001

(54) GOLF GLOVES

(76) Inventor: Thomas M Fraser, 187 Wheelwright Rd., Hampstead, NH (US) 03841

( * ) Notice: Subject to any disclaimer, the term of this patent is extended or adjusted under 35 U.S.C. 154(b) by 0 days.

(21) Appl. No.: 09/371,764

(22) Filed: Aug. 10, 1999

(51) Int. Cl.[7] ..... A41D 19/00
(52) U.S. Cl. ..... 2/161.2; 2/159; 2/161.1
(58) Field of Search ..... 2/159, 160, 161.1, 2/161.2, 161.3, 161.6, 161.8, 167, 169; 473/458, 205

(56) References Cited

U.S. PATENT DOCUMENTS 3,508,280 * 4/1970 Osborn ..... 2/161.3
4,665,565 * 5/1987 Odom ..... 2/159
5,028,050 * 7/1991 Freyer ..... 2/161.3
5,184,827 * 2/1993 Suttle et al. ..... 2/161.3
5,232,225 * 8/1993 Snyder ..... 2/161.3
5,542,126 * 8/1996 Harvanek ..... 2/161.1
5,644,795 * 7/1997 Landis et al. ..... 2/161.3
5,704,065 * 1/1998 Feuerhake ..... 2/161.2

* cited by examiner

*Primary Examiner*—John J. Calvert
*Assistant Examiner*—Gary L. Welch
(74) *Attorney, Agent, or Firm*—Joseph E. Funk

(57) ABSTRACT

A pair of golf gloves each having loop and pile interfaces at specific locations that fasten together as a golfer grasps a golf club, and they aid the golfer to properly grasp, hold and maintain a preferred neutral hold on a golf club during back swing and forward swing to achieve a good golf shot.

5 Claims, 4 Drawing Sheets

GOLF GLOVES

FIELD OF THE INVENTION

The present invention relates to training devices used for practicing golf skills and more specifically to a pair of golf gloves worn playing golf that will aid a golfer in achieving and maintaining a preferred grip on a golf club.

PRIOR ART

Achieving and maintaining the consistency and feel of the preferred grip position on a golf club is somewhat difficult to learn, especially for beginner and intermediate golfers. A faulty grip position, whether too strong or too weak, directly affects the position of the club face at impact leading to shots that end up well right or well left of the target. In addition, many of these golfers, upon addressing a ball, tend to fidget around with their grip position and may inadvertently shift their hands on a golf club during their back swing and forward swing, adversely affecting their golf shot.

Most golf instructors tell their students that in order to execute a well coordinated, smooth flowing, swing of a golf club, the fundamentals of a neutral grip position must first be learned and repeatedly practiced. Many amateur golfers tend to grasp a golf club without careful consideration of their hand position on the club. They may also use one or two golf gloves. Such gloves do enhance the golfers grip on the club, but none have been produced that direct and secure a golfer's hands in the preferred neutral grip position.

Thus, there is a need in the art for an aid to help a golfer achieve and maintain a preferred neutral grip position on the golf club during the entire swing to realize a golf shot.

SUMMARY OF THE INVENTION

The foregoing need in the prior art is satisfied by the present invention. The present invention provides a pair of interlocking golf gloves which help a golfer achieve, secure and maintain the preferred neutral grip position on a golf club during the entire swing process and to achieve a good golf shot. These golf gloves are properly sized, easily worn and are not cumbersome on the golf course.

The golf gloves of the preferred embodiment of the invention utilize hook and pile fasteners of the type available commercially under the trademark VELCRO®. Segments of such hook and pile fasteners are permanently attached to each of the gloves. A golfer wearing a pair of these golf gloves is aided in how to properly grip a golf club in a preferred neutral grip so as not to have: (a) too weak a grip where the golf club handle slides into the lifeline of the golfer's upper hand instead of resting in the heel pad of the hand and results in slicing a golf shot; or (b) too strong a grip where there is pressure in the upper hand wrist socket and the outside of the lower arm forearm tighten up and results in a hook shot. With the preferred neutral grip a golfer will achieve and maintain the preferred grip on a golf club during an entire swing to achieve a good golf shot.

For a right handed golfer their upper hand is their left hand and their lower hand is their right hand. Conversely, for a left handed golfer their upper hand is their right hand and their lower hand is their left hand.

DESCRIPTION OF THE DRAWING

The invention will be better understood upon reading the following Detailed Description in conjunction with the drawings in which:

FIG. 2 is a palm up view of the left hand glove with the thumb folded in;

DETAILED DESCRIPTION

Figure 1:
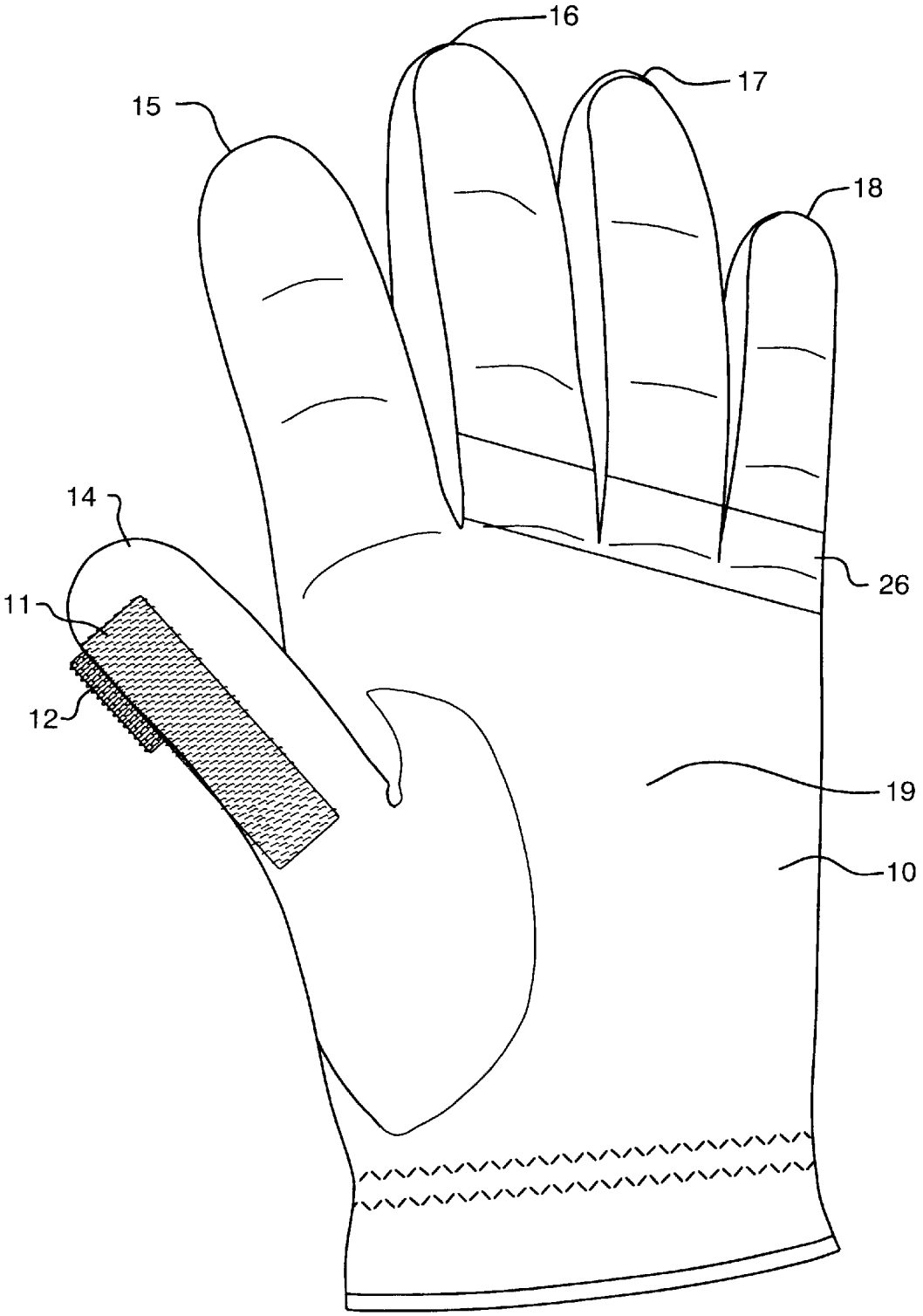
FIG. 1 is a palm up view of the left hand glove with the thumb extended.
Figure 2:
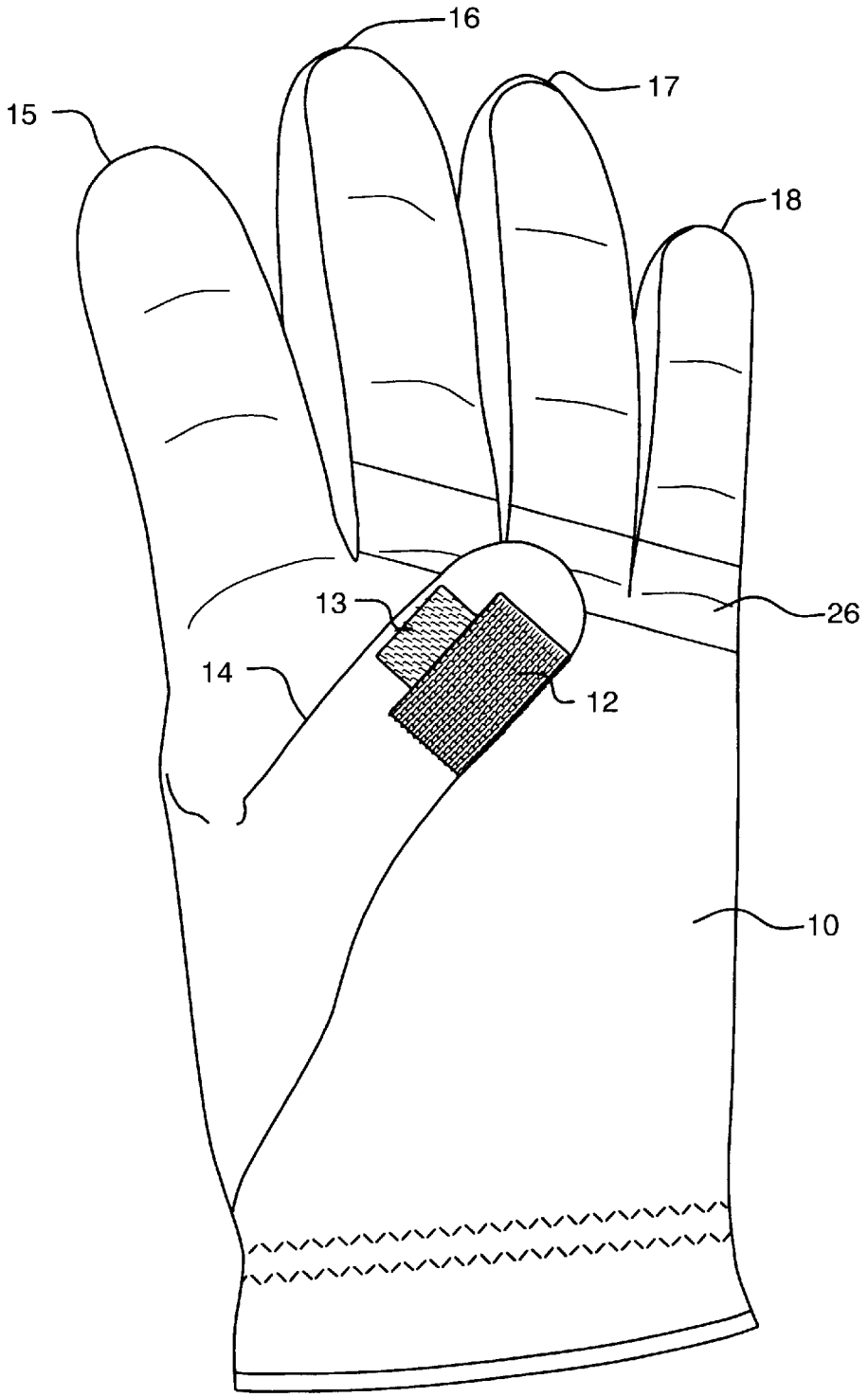
Figure 3:
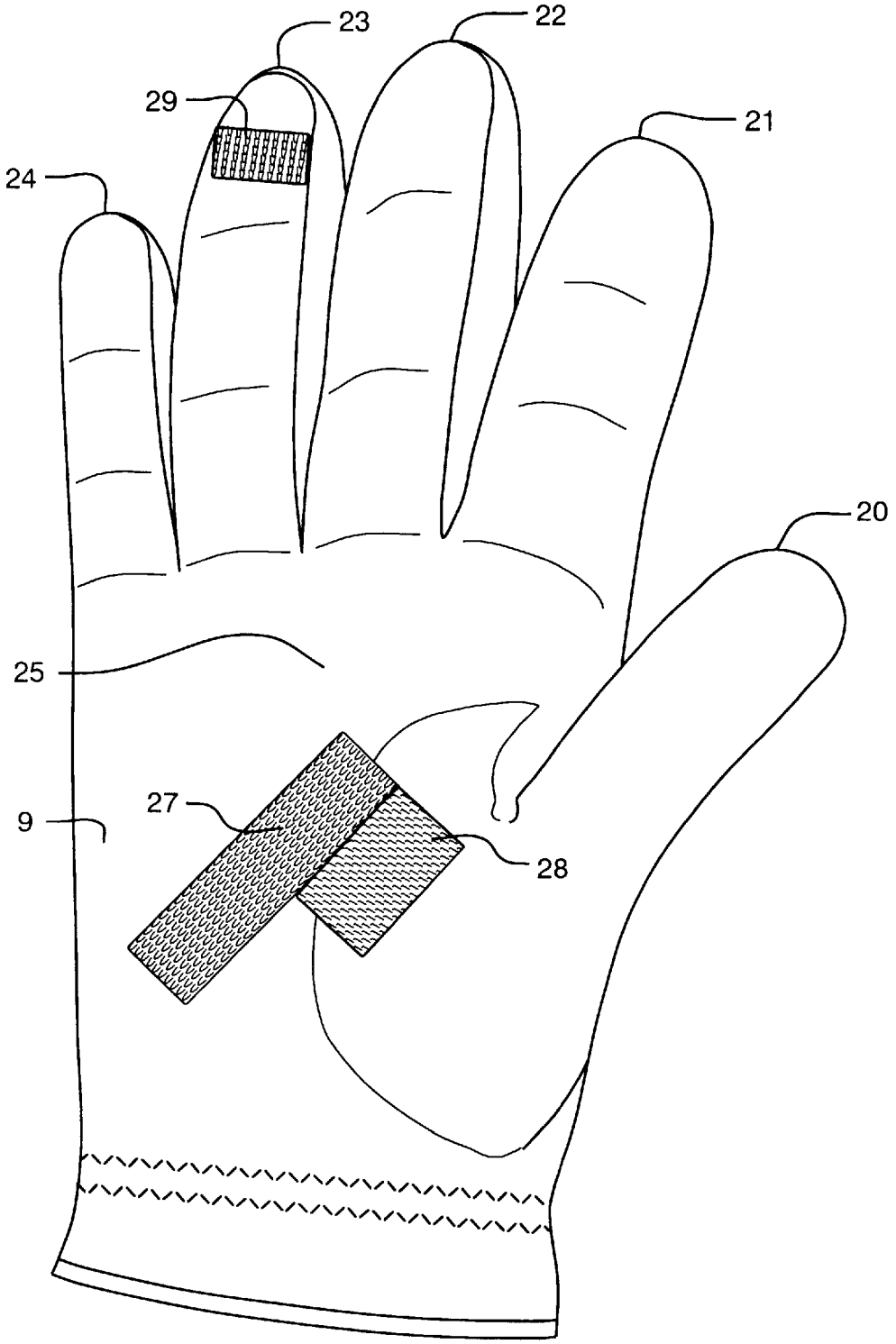
FIG. 3 is a palm up view of the right hand glove with the thumb extended.

The pair of golf gloves described herein are for a right handed person. Therefore, the left hand glove 10 shown in FIGS. 1 and 2 are for the upper hand (furthest from the ground), and the right hand glove 9 shown in FIG. 3 is for the lower hand (closest to the ground). For a pair of golf gloves for a left handed person the position of the hook and pile fasteners on the left hand glove 10 and right hand glove 9 are reversed. For a left handed person the right hand is the upper hand and the hook and pile fasteners shown in FIGS. 1 and 2 would instead be oil the right hand glove 9 in a mirror image orientation. Similarly, for the left handed person the left hand is the lower hand and the hook and pile fasteners shown in FIG. 3 would instead be on the left hand glove 10 in a mirror image orientation.

In FIGS. 1 and 2, left hand glove 10 has fastener elements 11 and 13 that are hook type material and fastener element 12 that is a pile type material. On the right hand glove 9 shown in FIG. 3 fastener elements 27 and 29 are pile type material and fastener element 28 is hook type material. As is well-known in the fastener art, pile type material will not fasten to other pile type material, hook type material will not fastened to other hook type material, but hook type material will fasten firmly to pile type material. The orientation of hook type and pile type fastener material on the left hand glove 10 and right hand glove 9 is such that a golfer cannot inadvertently hold a golf club in a wrong matter and fasten the left hand glove 10 to the right hand glove 9 in an improper orientation.

Left golf glove 10, shown in FIGS. 1 and 2, has a glove thumb 14, index glove finger 15, middle glove finger 16, ring glove finger 17, little glove finger 18, and palm area 19. Attached to glove finger 14 are three pieces of fastener material. An elongated piece of hook type fastener material 11 is attached to the side of glove thumb 14 on the side furthest from glove index finger 15. A piece of pile type fastener material 12 is attached to the back side of glove thumb 14 adjacent to tip end of glove thumb 14 and adjacent to fastener material 11 as shown. A piece of hook type fastener material 13 is attached to the side of glove thumb 14 on the side nearest to glove index finger 15, adjacent to the tip of glove thumb 14, and adjacent to fastener material 12 as shown.

Fastener material 11, 12 and 13 fasten to and cooperate with other faster elements attached to right hand glove 11, shown in FIG. 3, and these other faster elements are described further in this Detailed Description with reference to FIG. 3.

In FIG. 3, right golf glove 9 has a glove thumb 20, index glove finger 21, middle glove finger 22, ring glove finger 23, little glove finger 24, and palm area 25. Attached to right golf glove 9 are fastener elements 14, 15 and 29. Fasteners 14 and 29 are pile type material, and fastener 28 is hook type material.

Fastener 27 is elongated, is the same length as fastener 11 on left glove 10, and is attached to the palm of the lower hand right glove 9 near, but spaced from, the base of glove thumb 20. Fastener 28 is attached to the base of the glove thumb 20. Fastener 29 is attached to the tip of glove ring finger 23 on the palm side of glove 11.

When gloves 9 and 10 are worn by a golfer who is holding a golf club (not shown) to swing same, and the hook and loop fastener elements on both gloves 9 and 10 are all properly fastened to each other, they are fastened together as follows. Hook fastener 11 on left golf glove 10 is parallel to and fastened to loop fastener 27 on right golf glove 9. Loop fastener 12 on left golf glove 10 is fastened to hook fastener 28 on right golf glove 9. Loop fastener 29 on right golf glove 9 is fastened to hook fastener 13 on left golf glove 10.

Across the base of fingers 16, 17 and 18 of left golf glove 10, and on the palm side of the glove, is a colored stripe 26 that guides the correct placement of a golf club (not shown) in the left hand of the golfer. Any color may be used. After laying the club head on the ground in one of the well known open, closed or squared positions, as selected by the golfer, the golfer wearing gloves 9 and 10 places the handle of the golf club (not shown) along the colored stripe 26 across the palm side of left golf glove 10 and closes the left hand over the club handle. Left golf glove 10 fingers 16, 17 and 18 are firmly but softly closed around the golf club handle. Glove thumb 14 is placed parallel to and along the shaft of the golf club pointing toward the head of the club. Left glove 10 index finger 15 is not closed around the shaft of the golf club, but is curved slightly and lightly touches the handle of the golf club.

The golfer then places right golf glove 9 around the shaft of the golf club using fasteners 11 and 12 on left golf glove 10 as a guide to fasten its fastener 27 to fastener 11 on left golf glove 10, and its fastener 28 to fastener 12 on left golf glove 10. Fasteners 11 and 27 are elongated and are positioned parallel to and directly on top of each other when they are brought into contact to fasten them together. Right glove glove 9 thumb 20 is placed parallel to and along the shaft of the golf club (see FIG. 4) pointing toward the head of the club. Right golf glove 9 thumb 20 is then rolled leftward to fasten its fastener 28 to fastener 12 on left golf glove 10. Right golf glove 9 fingers 22, 23 and 24 are then firmly but softly closed around the golf club handle. As this is done fastener 29 on the tip of right golf glove 9 ring finger 23 is pushed into and fastens to fastener 13 on the end of left golf glove 10 thumb 14. Right glove index finger 21 is not fully closed around the shaft of the golf club, but is curved and touches the shaft of the club in a well known manner. Gloves 9 and 10 are now fastened together in a preferred neutral hold around the golf club (see FIG. 4) and remain in that hold during a back swing and forward swing to hit a golf ball.

Figure 4:
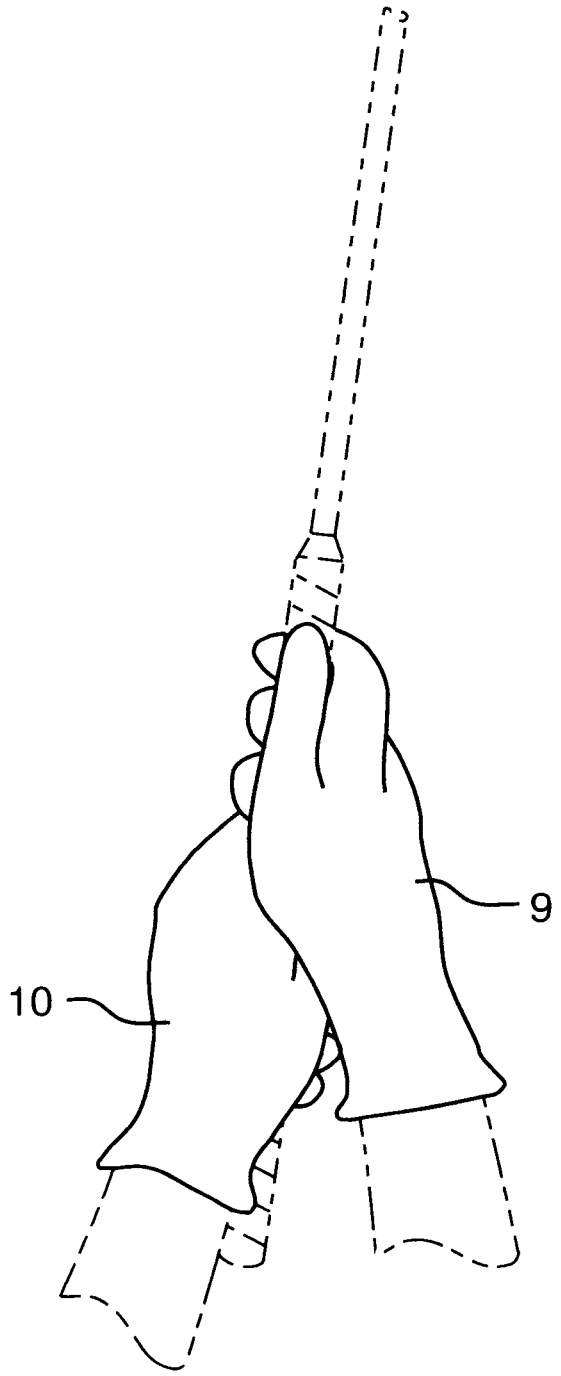
FIG. 4 shows a top view of a golfer holding a golf club in a preferred manner using the golf gloves.

In FIG. 4 is shown a top view of a golfer holding a golf club in the preferred neutral manner described in the previous paragraph using gloves 10 and 11.

While what has been described above is the preferred embodiment of the invention, it will be understood that changes may be made thereto without departing from the spirit and scope of the invention. For example, fastener means other than loop and pile fasteners may be utilized, or no fasteners at all need be utilized.

For more experienced golfers the previously described fasteners may be replaced with colored areas or interface elements, similar to colored stripe 26, to direct the placement of the golfer's hands. Fasteners 11 and 27 would be replaced by colored interface elements of a first color that may or may not have the same shape and size as the fasteners, fasteners 12 and 28 would be replaced by colored interface elements of a second color that may or may not have the same shape and size as the fasteners, and fasteners 13 and 29 would be replaced by colored interface elements of a third color that may or may not have the same shape and size as the fasteners. A golfer wearing such gloves would align the like colored interfaces on each of the gloves, as described above for the fasteners, to achieve the preferred neutral grip on the golf club.

What is claimed is:

1. A pair of golf gloves, each glove having a glove thumb, a glove ring finger, a glove index finger and a glove palm, the pair of gloves having a upper hand glove and a lower hand glove with the lower hand glove being for the right hand of a right handed person or for the left hand of a left handed person, and the upper hand glove being for the left hand of a right handed person or for the right hand of a left handed person, said golf gloves aiding holding a golf club in a preferred hand to club connection, said pair of gloves comprising:

a first interface element attached to the side of the glove thumb of the upper hand glove closest to the glove index finger when viewing the back of all fingers of the glove; and a second interface element attached to the outer end of the glove ring finger of the lower hand glove on the palm side of the glove, said second interface element being fastened to and cooperating with said first interface element to help a wearer of said golf gloves to properly hold and swing a golf club while maintaining the preferred hand to club connection through a swing.

2. The invention in accordance with claim 1 further comprising:

a third interface element attached to the palm of the lower hand glove near but spaced from the base end of the glove thumb; and a fourth interface element attached to the side of the glove thumb of the upper hand glove furthest from the glove index finger, said fourth interface element being fastened to and cooperating with said third interface element to help a wearer of said golf gloves to properly hold and swing a golf club while maintaining the preferred hand to club connection through a swing.

3. The invention in accordance with claim 2 further comprising:

a fifth interface element attached to the palm of the lower hand glove adjacent to the base of the glove thumb; and a sixth interface element attached to the back of the glove thumb of the upper hand glove at the tip end of the glove thumb, said sixth interface element being fastened to and cooperating with said fifth interface element to help a wearer of said golf gloves to properly hold and swing a golf club while maintaining the preferred hand to club connection through a swing.

4. The invention in accordance with claim 3 wherein said third interface element and said fourth interface element are elongated strips that are oriented parallel to each other when they are fastened together to properly hold and swing a golf club while maintaining the preferred hand to club connection through a swing.

5. The invention in accordance with claim 1 further comprising:

a third interface element attached to the palm of the lower hand glove adjacent to the base of the glove thumb; and a fourth interface element attached to the back of the glove thumb of the upper hand glove at the tip end of the glove thumb, said fourth interface element being fastened to and cooperating with said third interface element to help a wearer of said golf gloves to properly hold and swing a golf club while maintaining the preferred hand to club connection through a swing.

* * * * *